US012582209B2

(12) United States Patent
Zhang et al.

(10) Patent No.: US 12,582,209 B2
(45) Date of Patent: Mar. 24, 2026

(54) FLUFFING AND STYLING NOZZLE AND HAIR DRYER

(71) Applicant: WAHL CLIPPER CORPORATION

(72) Inventors: Hao Zhang, Ningbo (CN); Wuhu Li, Ningbo (CN); Qing Wang, Ningbo (CN)

(73) Assignee: WAHL CLIPPER CORPORATION, Sterling, IL (US)

( * ) Notice: Subject to any disclaimer, the term of this patent is extended or adjusted under 35 U.S.C. 154(b) by 572 days.

(21) Appl. No.: 18/002,819

(22) PCT Filed: Jun. 28, 2021

(86) PCT No.: PCT/CN2021/102629
§ 371 (c)(1),
(2) Date: Dec. 21, 2022

(87) PCT Pub. No.: WO2022/001919
PCT Pub. Date: Jan. 6, 2022

(65) Prior Publication Data

US 2023/0240424 A1 Aug. 3, 2023

(30) Foreign Application Priority Data

Jul. 3, 2020 (CN) ..... 202010632072.3

(51) Int. Cl.
*A45D 20/12* (2006.01)

(52) U.S. Cl.
CPC ..... *A45D 20/122* (2013.01)

(58) Field of Classification Search
CPC ..... A45D 20/122; A45D 20/12
See application file for complete search history.

(56) References Cited

U.S. PATENT DOCUMENTS 4,287,673 A * 9/1981 Wolter ..... A45D 20/122 239/524
4,391,047 A * 7/1983 Janssens ..... A45D 20/122 239/602

(Continued)

FOREIGN PATENT DOCUMENTS

CN 106256285 A 12/2016
CN 205923306 U 2/2017

(Continued)

OTHER PUBLICATIONS

Communication and Supplementary Search Report received in European Application No. 21833673.3, dated Jun. 27, 2024.

(Continued)

*Primary Examiner* — Edelmira Bosques
*Assistant Examiner* — Bao D Nguyen
(74) *Attorney, Agent, or Firm* — Greer, Burns & Crain, Ltd

(57) ABSTRACT

A fluffing and styling nozzle, includes a diffusing shell, a mesh cylinder, a flow dividing platform, a baffle plate, a magnetic part supporting rib reverse side, a middle air outlet hole and an internal diffusing chamber; the flow dividing platform and the baffle plate are on the diffusing shell, the baffle plate is at the bottom of the flow dividing platform, and the baffle plate and the magnetic part supporting rib reverse side form a side surface gap flow channel; gas flowing from the fluffing and styling nozzle is from the middle air outlet hole and the side surface gap flow channel, gas flowing from the middle air outlet hole enters the internal diffusing chamber, gas flowing from the side surface gap flow channel is guided by the baffle plate to mesh cylinder side surfaces, and gases flowing from the two portions flow out mesh openings of the mesh cylinder.

9 Claims, 4 Drawing Sheets

(56) References Cited

U.S. PATENT DOCUMENTS

| | | | | |
|---|---|---|---|---|
| 4,848,007 | A * | 7/1989 | Montagnino | A45D 20/122 34/97 |
| 5,275,339 | A * | 1/1994 | Andis | A45D 20/122 239/443 |
| 5,488,783 | A * | 2/1996 | Parkinson | A45D 20/122 34/283 |
| 5,671,547 | A * | 9/1997 | Truchet | A45D 20/12 34/96 |
| 6,089,239 | A * | 7/2000 | Ehlhardt | A45D 20/122 132/271 |
| 6,148,537 | A | 11/2000 | Altamore | |
| 6,766,590 | B2 | 7/2004 | Altamore et al. | |
| 6,775,922 | B2 | 8/2004 | Langley et al. | |
| 6,957,500 | B2 | 10/2005 | McCambridge et al. | |
| 7,178,261 | B2 | 2/2007 | McCambridge et al. | |
| 8,302,613 | B2 | 11/2012 | Yde et al. | |
| 8,407,913 | B2 | 4/2013 | Langley et al. | |
| 9,743,737 | B1 * | 8/2017 | Malbrough | A45D 20/10 |
| 2003/0177657 | A1 * | 9/2003 | Andis | A45D 20/122 34/96 |
| 2005/0108889 | A1 * | 5/2005 | Leventhal | A45D 20/122 34/96 |
| 2005/0257395 | A1 * | 11/2005 | Keong | A45D 20/122 239/553.3 |
| 2008/0271337 | A1 * | 11/2008 | Chan | A45D 20/122 132/271 |
| 2008/0301968 | A1 * | 12/2008 | Lee | A45D 20/12 34/96 |
| 2015/0026993 | A1 * | 1/2015 | Sutter | A45D 20/12 34/96 |
| 2015/0335128 | A1 * | 11/2015 | Larkin | A45D 20/12 34/553 |
| 2015/0366316 | A1 * | 12/2015 | Soresina | A45D 20/12 239/592 |
| 2016/0206075 | A1 * | 7/2016 | Stephens | A45D 20/12 |
| 2016/0220004 | A1 * | 8/2016 | Moloney | A45D 20/122 |
| 2016/0367003 | A1 * | 12/2016 | Stephens | A45D 20/122 |
| 2016/0367004 | A1 * | 12/2016 | Stephens | A45D 20/122 |
| 2016/0367005 | A1 * | 12/2016 | Stephens | A45D 20/122 |
| 2016/0367006 | A1 * | 12/2016 | Stephens | A45D 20/122 |
| 2016/0367007 | A1 * | 12/2016 | Stephens | A45D 20/122 |
| 2016/0367008 | A1 * | 12/2016 | Stephens | A45D 20/122 |
| 2017/0172276 | A1 * | 6/2017 | Hsu | A45D 20/12 |
| 2019/0075905 | A1 | 3/2019 | Kennedy et al. | |
| 2019/0313761 | A1 | 10/2019 | Gebhard | |
| 2021/0321738 | A1 * | 10/2021 | Ni | A45D 20/12 |
| 2023/0380567 | A1 * | 11/2023 | Lim | A45D 20/122 |
| 2024/0206614 | A1 * | 6/2024 | Debenedictis | A45D 20/124 |

FOREIGN PATENT DOCUMENTS

| | | | |
|---|---|---|---|
| CN | 109480440 | A | 3/2019 |
| CN | 111772317 | A | 10/2020 |
| CN | 111802780 | A | 10/2020 |
| TW | M501763 | U | 6/2015 |

OTHER PUBLICATIONS

International Search Report and Written Opinion received for PCT/CN2021/102629, mailed Aug. 30, 2021.

* cited by examiner

FLUFFING AND STYLING NOZZLE AND HAIR DRYER

BACKGROUND

The present invention relates to the technical field of a hair dryer, and in particular, to a fluffing and styling nozzle and a hair dryer, particularly a fluffing and styling nozzle suitable for different hair dryers.

Nowadays, people's desire for beautiful thins is increasing day by day, and hairstyle has an important influence on a person's overall perception. However, it takes a long time to change the hair quality; therefore, the hair quality may be improved by external means. At present, the hair dryers on the market have the common blow-drying function, so we need to make the air fluffy without damaging the hair to solve the trouble of people with flat hair.

After retrieval, the patent document CN205923306U discloses a hair dryer air gathering nozzle, including an air gathering nozzle shell, wherein an air channel penetrates through the air gathering nozzle shell, a rotary nozzle communicating with the air channel is embedded at an air outlet of the air channel, an outer wall of the rotary nozzle has a freedom to rotate along an inner wall of the air outlet of the air channel, a radial center of an air outlet of the rotary nozzle deviates from a central axis of the rotary nozzle, and a rotary blade is arranged on a rotary machine body. The structural design in the prior art is not conducive to constant-speed air output of the nozzle, the hair is easily injured when the air speed is too high, and the hair is blow-dried and styled uneasily when the air speed is too low; furthermore, the rotary blade will cause that the hair is knotted when being absorbed into the hair dryer, which is not conducive to normal use of the nozzle. In view of the above technical problems, it is urgent to solve such problems.

SUMMARY

For the defects in the prior art, an objective of the present invention is to provide a fluffing and styling nozzle to solve the problem of constant-speed air output of the hair dryer.

A fluffing and styling nozzle according to the present invention includes a diffusing shell, a mesh cylinder, a flow dividing platform, a baffle plate, a magnetic part supporting rib reverse side, a middle air outlet hole and an internal diffusing chamber, wherein the flow dividing platform and the baffle plate are arranged on the diffusing shell, the baffle plate is arranged at the bottom of the flow dividing platform, and the baffle plate and the magnetic part supporting rib reverse side form a side surface gap flow channel; and gas flowing out of the fluffing and styling nozzle is from the middle air outlet hole and the side surface gap flow channel, gas flowing out of the middle air outlet hole enters the internal diffusing chamber, gas flowing out of the side surface gap flow channel is guided by the baffle plate to side surfaces and edges of the mesh cylinder, and gases flowing out of the two portions flow out uniformly through mesh openings of the mesh cylinder.

Preferably, the fluffing and styling nozzle further includes a first fixing device, a locking device and a magnetic part, wherein the magnetic part is fixed by the first fixing device on the diffusing shell through the locking device.

Preferably, the fluffing and styling nozzle further includes an air outlet claw net, a second fixing device and a third fixing device, wherein the mesh cylinder is fixed on the diffusing shell by the second fixing device, and the air outlet claw net is fixed on the diffusing shell by the third fixing device.

Preferably, the mesh cylinder is provided with a plurality of mesh openings in an axial direction and a radial direction.

Preferably, the air outlet claw net is provided with a plurality of mesh openings distributed uniformly, and the mesh openings of the outlet claw net correspond to the mesh openings of the mesh cylinder in an overlapping portion.

Preferably, a plurality of protruded elbows are arranged on the air outlet claw net, a vertical section of each elbow is L-shaped, a corner of the L shape has a radian, and a cross section of one end, proximal to the air outlet claw net, of each elbow is round.

Preferably, a chamber formed between inner walls of the flow dividing platform on the diffusing shell is an internal diffusing chamber.

Preferably, a cross section of the diffusing shell is round and a side section view is trapezoidal.

Preferably, the mesh cylinder is provided with projections and grooves corresponding to each other in pairs, and is provided with a plurality of gaps in an outer edge of the bottom.

A hair dryer according to the present invention includes and is suitable for the fluffing and styling nozzle according to any one of the above.

Compared with the prior art, the present invention has the following beneficial effects:

1. by adoption of the structures of the flow dividing platform and the baffle plate on the diffusing shell, the problems about gas flow division and gas energy reduction and pressure reduction are solved.

2. By adoption of the structure of the inner wall, namely the internal diffusing chamber, of the flow dividing platform on the diffusing shell, the problem that gas flowing out of the center has too high air speed is solved.

3. By adoption of the structures of small holes on the mesh cylinder in the axial direction and the radial direction and the structure of the air outlet claw net, the problem of uniform gas distribution is solved.

4. The elbows and a sieve are provided for reducing fluid flow; meanwhile, a main diffusing chamber and the internal diffusing chamber are provided for increasing the section area of the air outlet flow channel, and part of dynamic pressure of the air is converted into the static pressure, thereby entirely reducing the flow speed of the gas.

5. The middle air outlet and the surrounding air outlet gaps are provided for dividing the gas, and the flow of the gas in each flow direction is controlled by adjusting the sizes of the middle air outlet hole and the surrounding air outlet gaps, so that air is output entirely and uniformly.

BRIEF DESCRIPTION OF DRAWINGS

The other features, objectives and advantages of the present invention will become more apparent by reading the detailed descriptions made for non-restrictive embodiments with reference to the following accompanying drawings.

In the drawings.

Figure 1:
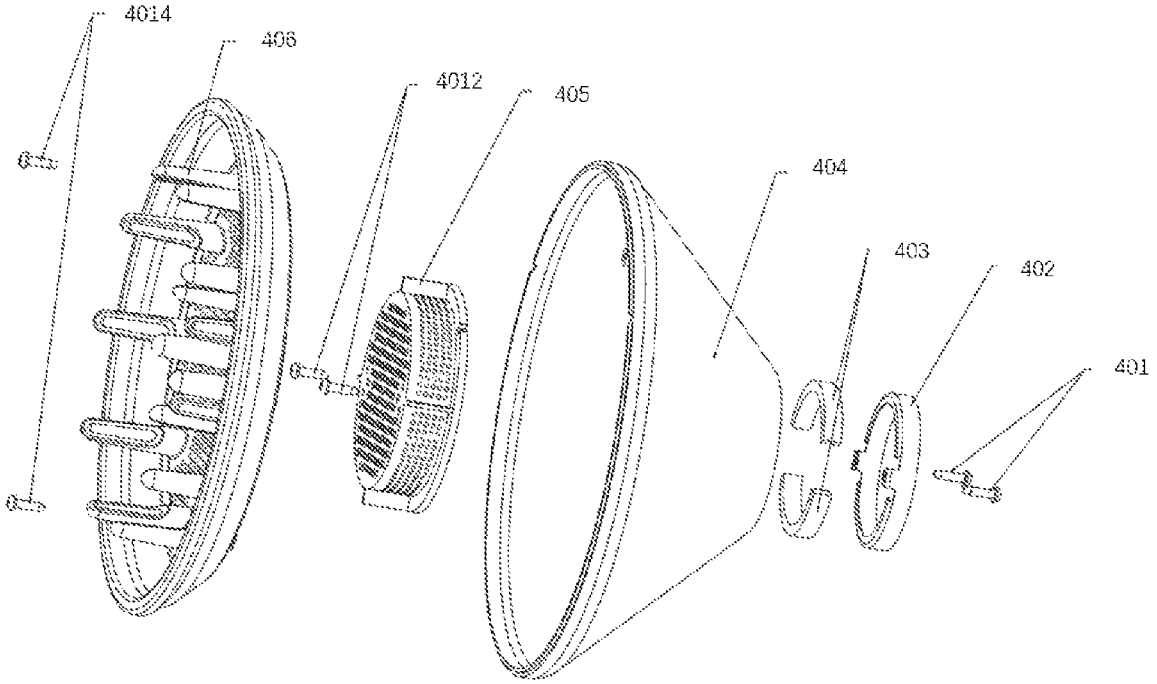
FIG. 1 is a first schematic diagram of a fluffing and styling nozzle according to the present invention.

first fixing device 401;
locking device 402;
magnetic part 403;
diffusing shell 404;
mesh cylinder 405;
air outlet claw net 406;
flow dividing platform 407;
baffle plate 408;
magnetic part supporting rib reverse side 409;
middle air outlet hole 4010;
internal diffusing chamber 4011;
second fixing device 4012;
main diffusing chamber 4013;
third fixing device 4014.

DETAILED DESCRIPTION

The present invention is described in detail below with reference to the specific embodiments. The following embodiments will help those skilled in the art to further understand the present invention, but do not limit the present invention in any way. It should be pointed out that several changes and improvements may be made by those of ordinary skill in the art without departing from the conception of the present invention. These changes and improvements all belong to the protection scope of the present invention.

Figure 2:
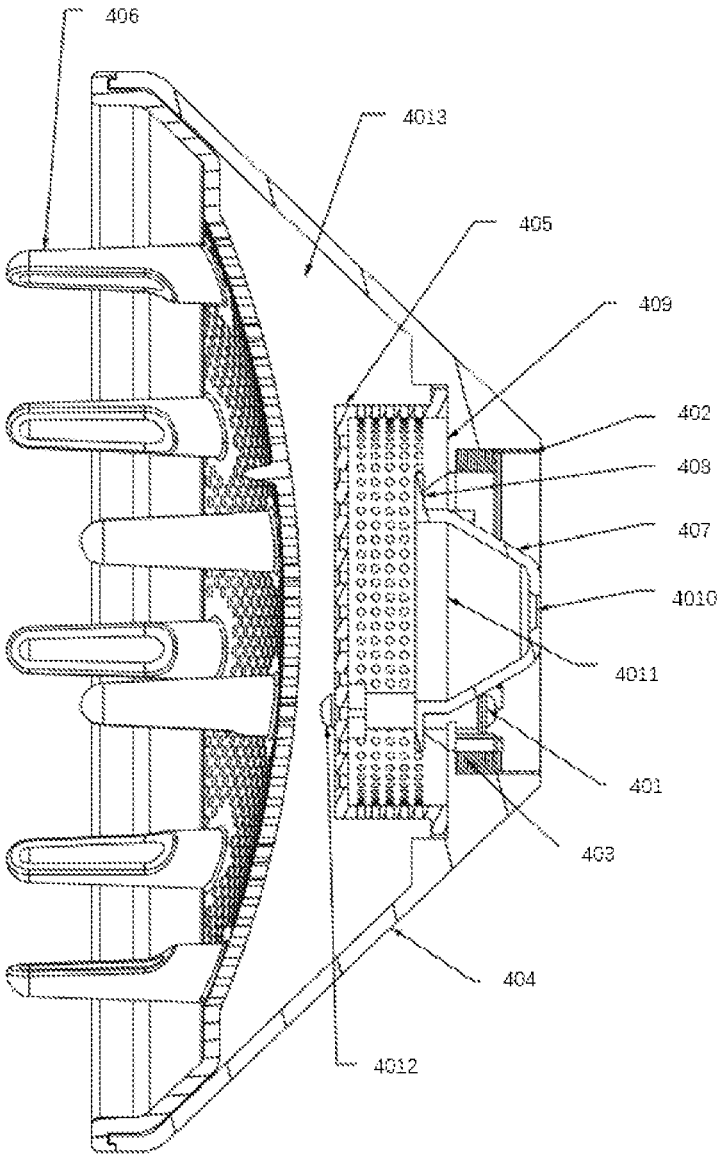
FIG. 2 is a second schematic diagram of a fluffing and styling nozzle according to the present invention.
Figure 3:
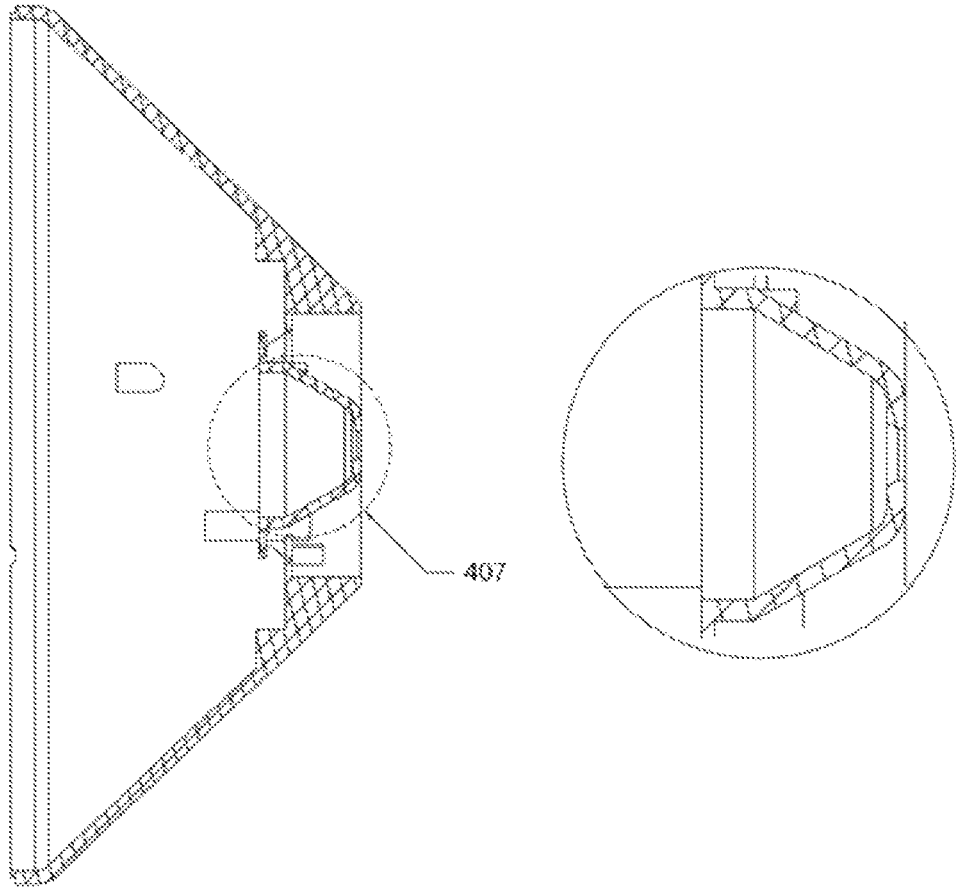
FIG. 3 is a partial enlarged drawing.
Figure 4:
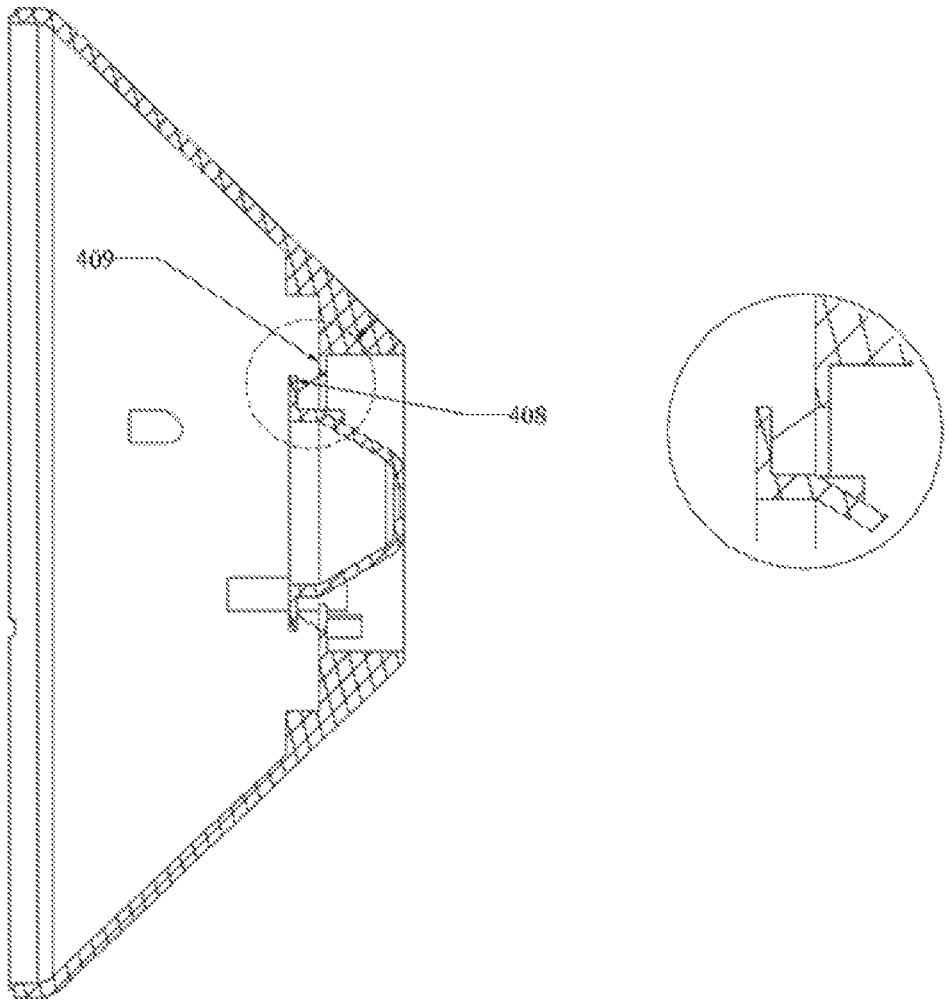
FIG. 4 is a partial enlarged drawing.

As shown in FIG. 1, FIG. 2, FIG. 3 and FIG. 4, the present invention provides a fluffing and styling nozzle, including: a first fixing device 401, a locking device 402, a magnetic part 403, a diffusing shell 404, a mesh cylinder 405, an air outlet claw net 406, a flow dividing platform 407, a baffle plate 408, a magnetic part supporting rib reverse side 409, a middle air outlet hole 4010, an internal diffusing chamber 4011, a second fixing device 4012, a main diffusing chamber 4013 and a third fixing device 4014, wherein the magnetic part 403 is fixed by the first fixing device 401 on the diffusing shell 404 through the locking device 402, the mesh cylinder 405 is fixed on the diffusing shell 404 through by the second fixing device 4012, and the air outlet claw net 406 is fixed on the diffusing shell 404 by the third fixing device 4014.

The flow dividing platform 407 and the baffle plate 408 are arranged on the diffusing shell 404, the baffle plate 408 is arranged at the bottom of the flow dividing platform 407, and the baffle plate 408 and the magnetic part supporting rib reverse side 409 form a side surface gap flow channel; and gas flowing out of the fluffing and styling nozzle is from the middle air outlet hole 4010 and the side surface gap flow channel, gas flowing out of the middle air outlet hole 4010 enters the internal diffusing chamber 4011, gas flowing out of the side surface gap flow channel is guided by the baffle plate to side surfaces and edges of the mesh cylinder 405, and gases flowing out of the two portions flow out uniformly through mesh openings of the mesh cylinder 405.

The air outlet claw net 406 and the mesh cylinder 405 are provided with a plurality of mesh openings in axial directions and radial directions, and the mesh openings of the outlet claw net 406 correspond to the mesh openings of the mesh cylinder 405 in an overlapping portion; and a chamber formed between inner walls of the flow dividing platform 407 on the diffusing shell 404 is an internal diffusing chamber 4011. A cross section of the diffusing shell 404 is round and a side section view is trapezoidal. The elbows and a sieve are provided for reducing fluid flow; meanwhile, a main diffusing chamber 4013 and the internal diffusing chamber are provided for increasing the section area of the air outlet flow channel, and part of dynamic pressure of the air is converted into the static pressure, thereby entirely reducing the flow speed of the gas. The middle air outlet 4010 and surrounding air outlet gaps are provided for dividing gas, and the flow of the gas in each flow direction is controlled by adjusting the sizes of the middle air outlet hole 4010 and the surrounding air outlet gaps, so that air is output entirely and uniformly.

A magnetic part supporting rib is a reinforcing rib on a plastic shell, and the magnetic part supporting rib reverse side 409 is one side of the rib to serve as a supporting surface, which is called a supporting rib for short.

The present invention is further described below with reference to a preferred example.

The first fixing device 401, the second fixing device 4012 and the third fixing device 4014 may adopt self-tapping screws without punching bottom holes and drilling wires.

The locking device 402 may adopt a stainless steel hoop; and the magnetic part 403 may adopt a rubidium iron boron sintered magnet for being connected to a main body of the electric hair dryer, and the magnet is adsorbed to metal iron on the air outlet of the hair dryer for fixing the electric hair dryer.

The present invention is further described below with reference to a change example.

The diffusing shell may adopt an ABS material or a PC material; and the mesh openings may be small round holes and may also be small square holes.

Working principle:

A frustum cap type flow dividing platform (hereinafter referred to as flow dividing platform 407) is arranged an inlet of the diffusing shell 404, the middle is punched, and the baffle plate 408 is arranged at the root of the flow dividing platform and forms a side surface gap flow channel with the magnet supporting rib reverse side 409. The gas is pressed into the fluffing and styling nozzle from an air duct of the hair dryer, enters the inlet of the diffusing shell 404 firstly, is divided on the flow dividing platform 407 to form many strands of gas flow, and the gas flow flows out of the middle air outlet hole 4010 and four sides of the flow dividing platform respectively. The flow dividing platform 407 blocks the front side of the gas except for the middle air outlet hole 4010, the gas has to change the flow direction to flow out from the side surface gap flow channel and from the middle air outlet hole 4010, and the gas energy is lost by the local resistance of the flow dividing platform 407. On the other hand, the baffle plate 408 at the root of the flow dividing platform 407 increases wind resistance and changes the flow direction of the gas, and is similar to an elbow to reduce the gas energy. Then, the gas (hereinafter referred as the middle outflow gas) flowing out of the middle air outlet hole 4010 enters the inner wall, namely the internal diffusing chamber, of the frustum cap type flow dividing platform. Due to the increase of the section area of the flow channel, the middle outflow gas diffuses and the flow speed is reduced. Gas (hereinafter referred as side outflow gas) flowing out of the four side surface gap flow channels enters into the mesh cylinder, the root of the mesh cylinder 405 is attached to the diffusing shell 404, and the side overflow gas only can flow out through the mesh openings in the front side and the side surfaces of the mesh cylinder 405. On one hand, the gas energy is reduced by the fine mesh openings of the mesh cylinder 405; and on the other hand, the flow becomes thinner, so that the outflow gas is more uniform. The middle outflow gas flows out of the internal diffusing chamber 4011 and enters into the mesh cylinder 405. Due to the mutual influence of the side overflow gas and the middle outflow gas, the gas passes through the fine mesh openings of the mesh cylinder 405 uniformly, similarly, the gas energy is further reduced. The side outflow gas and the middle outflow gas enter the main diffusing chamber 4013 after passing through the mesh cylinder 405. With the interaction between the gases and gradual increase of the inner section area of the main diffusing chamber 4013, the gas is entirely uniform and the speed is reduced. The wind resistance is further increased by the air outlet claw net 406 and the gas flow becomes thinner, so that the gas is output entirely uniformly at low speed.

The specific embodiments of the present invention are described above. It should be understood that the present invention is not limited to the above specific embodiments, and those skilled in the art may make various changes or modifications within the scope of the claims, which does not affect the essential content of the present invention. The embodiments of the present application and the features in the embodiments may be arbitrarily combined with each other without conflict.

What is claimed is:

1. A fluffing and styling nozzle, comprising: a diffusing shell, a mesh cylinder, a flow dividing platform, a baffle plate, a magnetic part supporting rib reverse side, a middle air outlet hole and an internal diffusing chamber;

the flow dividing platform and the baffle plate are arranged on the diffusing shell, the baffle plate is arranged at an open peripheral edge of the flow dividing platform, and the baffle plate and the magnetic part supporting rib reverse side form a side surface gap flow channel; and gas flowing out of the fluffing and styling nozzle is from the middle air outlet hole and the side surface gap flow channel, gas flowing out of the middle air outlet hole enters the internal diffusing chamber, gas flowing out of the side surface gap flow channel is guided by the baffle plate to side surfaces and edges of the mesh cylinder, and gases flow out uniformly through mesh openings of the mesh cylinder.

2. The fluffing and styling nozzle according to claim 1, further comprising a first fixing device, a locking device and a magnetic part, wherein the magnetic part is fixed by the first fixing device on the diffusing shell through the locking device.

3. The fluffing and styling nozzle according to claim 1, further comprising an air outlet claw net, a second fixing device and a third fixing device, wherein the mesh cylinder is fixed on the diffusing shell by the second fixing device, and the air outlet claw net is fixed on the diffusing shell by the third fixing device.

4. The fluffing and styling nozzle according to claim 3, wherein the air outlet claw net is provided with a plurality of mesh openings distributed uniformly, and the mesh openings of the outlet claw net correspond to the mesh openings of the mesh cylinder in an overlapping portion.

5. The fluffing and styling nozzle according to claim 3, wherein a plurality of protruded elbows are arranged on the air outlet claw net, a vertical section of each elbow is L-shaped, a corner of the L-shape has a radian, and a cross section of one end, proximal to the air outlet claw net, of each elbow is round.

6. The fluffing and styling nozzle according to claim 1, wherein the mesh cylinder is provided with a plurality of mesh openings in an axial direction and a radial direction.

7. The fluffing and styling nozzle according to claim 1, wherein a chamber formed between inner walls of the flow dividing platform on the diffusing shell is the internal diffusing chamber.

8. The fluffing and styling nozzle according to claim 1, wherein a cross section of the diffusing shell is round, and a side section view is trapezoidal.

9. The fluffing and styling nozzle according to claim 1, wherein the mesh cylinder is provided with projections and grooves corresponding to each other in pairs, and is provided with a plurality of gaps in an outer edge of the bottom.

* * * * *